United States Patent [19]

Hamada

[11] 4,438,553

[45] Mar. 27, 1984

[54] FULL AUTOMATIC LEASING MACHINE FOR A WARP BEAM CONTAINING WARPS OF DIFFERENT COLORS

[75] Inventor: Shoichi Hamada, Otsu, Japan

[73] Assignee: Todo Seisakusho Ltd., Japan

[21] Appl. No.: 233,195

[22] Filed: Feb. 10, 1981

[51] Int. Cl.[3] ..... D02H 9/00; D03J 1/13

[52] U.S. Cl. ..... 28/184; 28/198

[58] Field of Search ..... 28/184, 198, 201, 202

[56] References Cited

U.S. PATENT DOCUMENTS

| | | | |
|---|---|---|---|
| 1,928,724 | 10/1933 | Homan | 28/184 |
| 2,126,634 | 8/1938 | Homan | 28/184 |
| 2,564,329 | 8/1951 | Fleischer | 28/202 |
| 2,690,606 | 10/1954 | Fleischer | 28/202 |
| 2,907,092 | 10/1959 | Altenweger | 28/202 |
| 4,152,815 | 5/1979 | Altenweger | 28/198 |
| 4,164,805 | 8/1979 | Altenweger | 28/202 |

*Primary Examiner*—Robert Mackey

*Attorney, Agent, or Firm*—Ostrolenk, Faber, Gerb & Soffen

[57] ABSTRACT

An automatic leasing machine for a warp beam on which a warp delivered from the warp beam is grouped into separate warp sheets of different colors, and warps from a warp sheet in turn are subsequently separated from the sheet, passed through a gap between a pair of warp leasing cords which alternate positions once per one warp passing, and fixed by means of bonding tapes. The foregoing operation is repeated cyclically in a fully automatic fashion for all warps in the warp sheet in accordance with a given stripe design of the yarn dyed fancy fabric to be woven.

12 Claims, 17 Drawing Figures

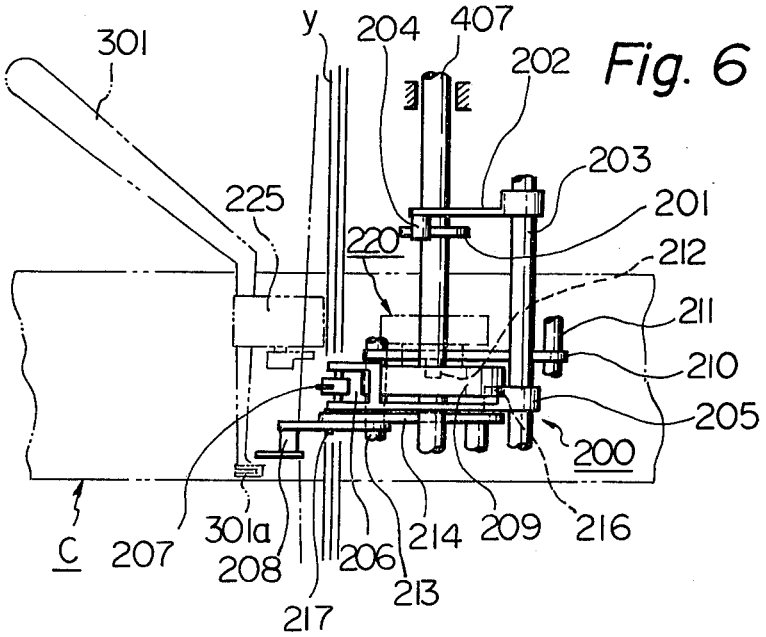
Fig. 6
Fig. 7
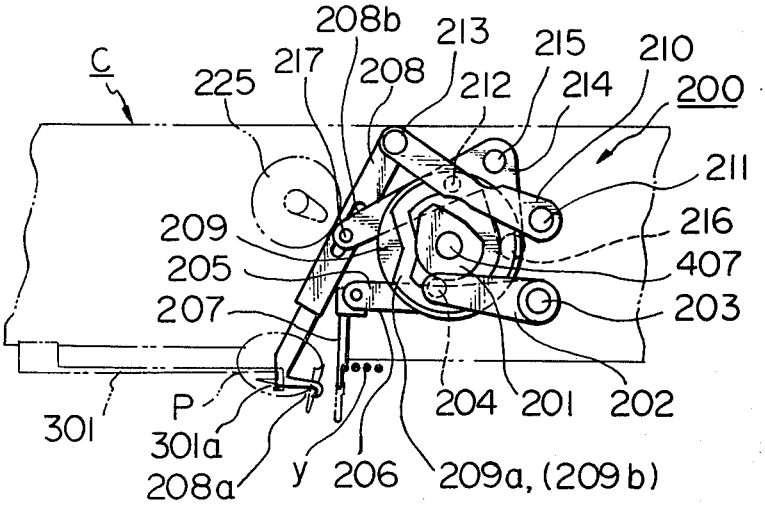

FULL AUTOMATIC LEASING MACHINE FOR A WARP BEAM CONTAINING WARPS OF DIFFERENT COLORS

BACKGROUND OF THE INVENTION

The present invention relates to a fully automatic leasing machine for a warp beam containing warps of different colors, and more particularly relates to a fully automatic machine which carries out leasing of warps of different colors in accordance with a given stripe design program stored in punch cards as a preparation for weaving of yarn dyed fancy fabrics.

Warp leasing is usually carried out as a preparatory process of warp tying for weaving of yarn dyed fancy fabrics. Conventionally, this process is carried out by mostly manual labour. First, warps delivered from a warp beam are grouped into separate warp sheets of different colors. Next, warps in each sheet are manually leased in reference to the stripe design table of the fancy fabric to be woven.

This manual leasing, however, requires a great deal of labor and time, since a warp beam usually contains a vast number of warps. In addition, the delicate nature of the operation requires highly skilled technique, and causes serious fatigue of the operators involved.

SUMMARY OF THE INVENTION

It is the basic object of the present invention to greatly reduce the manual labor and operation time necessary for a warp leasing operations.

It is another object of the present invention to carry out a fine and correct warp leasing operations without the need for highly skilled operators.

It is another object of the present invention to release the operators involved in warp leasing operations from fatigue.

In accordance with the present invention, warps in a warp sheet in turn are subsequently separated from their associated warp sheet by the combined operation of a pair of moving needles mounted on a warp driving unit, which unit travels in the width direction of said warp sheet. The warps so separated are then subsequently passed through a gap between a pair of warp leasing cords, which cords alternate their positions once per one warp passing by horizontal reciprocation of a hook mounted on a warp leasing unit which travels in synchronism with and in the same direction as the warp dividing units. Ends of the warps so passed are then subsequently fixed by a pair of bonding tapes to maintain them in their proper respective orientation.

BRIEF DESCRIPTION OF THE DRAWINGS

FIG. 6 is an enlarged front view of the warp separating mechanism used for the machine shown in FIGS. 1 to 3, FIG. 7 is a plan view of the warp separating mechanism shown in FIG. 6, FIGS. 8 and 9 are front and plan views of the first warp flipping mechanism used for the machine shown in FIGS. 1 to 3, FIGS. 10 and 11 are side and back views of the warp passing and warp leasing unit driving mechanisms used for the machine shown in FIGS. 1 to 3.

DESCRIPTION OF THE PREFERRED EMBODIMENT (1) The overall construction and operation of the machine.

Figure 1:
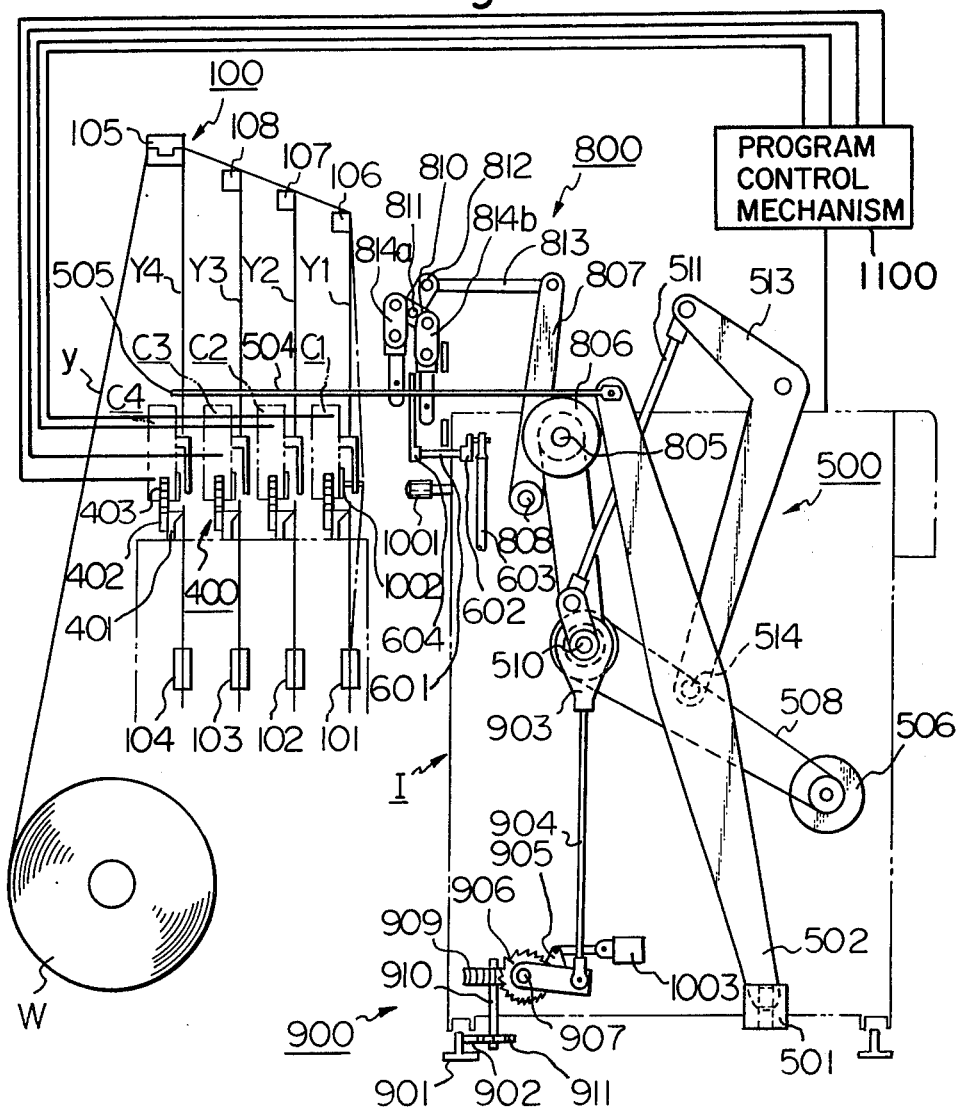
FIG. 1 is a side view of one embodiment of the automatic leasing machine in accordance with the present invention on which warps of four different colors are processed.
Figure 2:
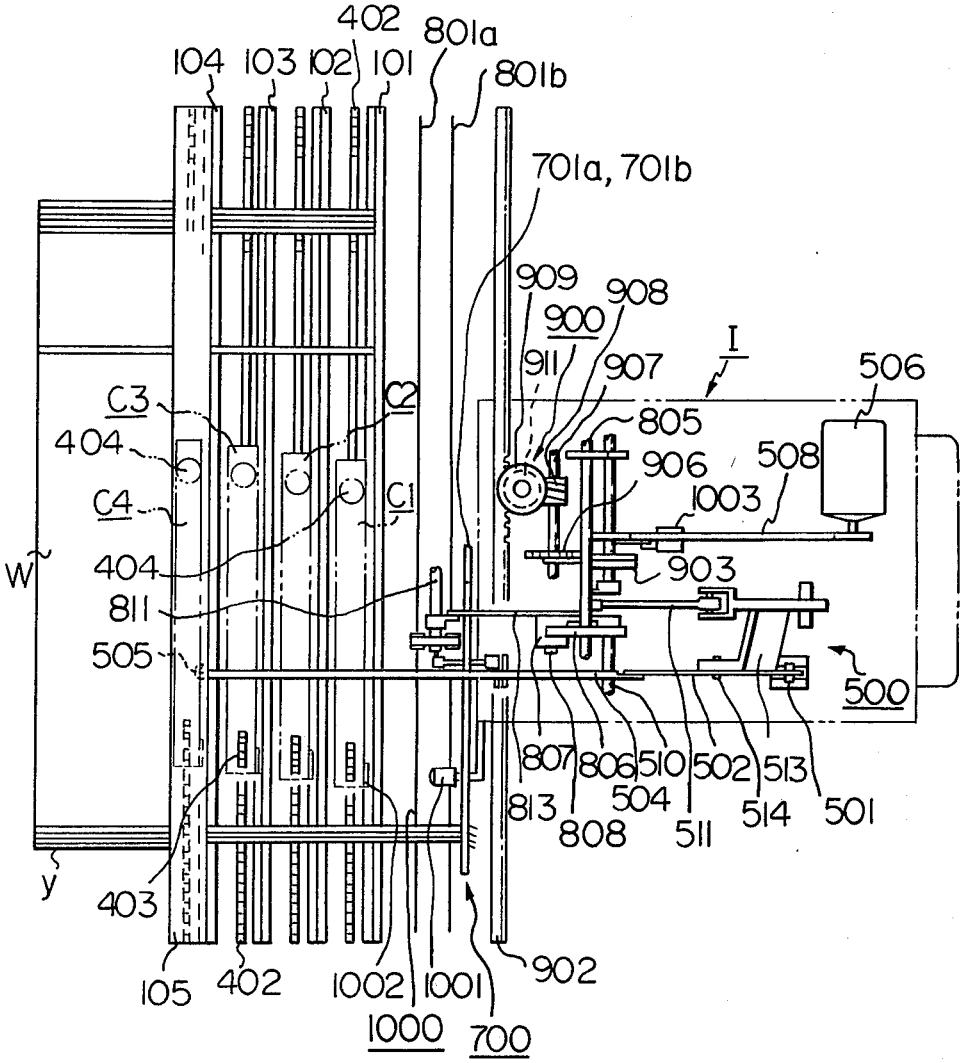
FIG. 2 is a plan view of the leasing machine shown in FIG. 1.
Figure 3:
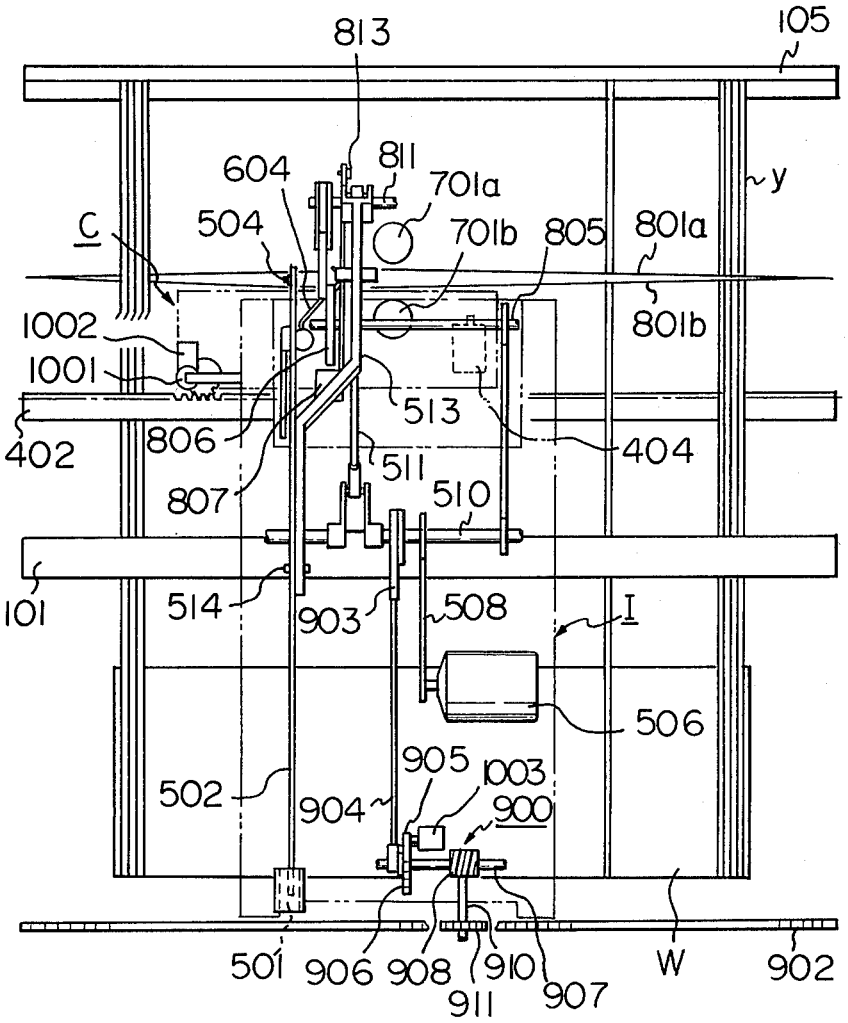
FIG. 3 is a front view of the leasing machine shown in FIG. 1.

The overall construction of the automatic leasing machine in accordance with the present invention is shown in FIGS. 1 through 3, in which warps of four different colors are wound on a common warp beam W.

The leasing machine includes a warp grouping mechanism 100 arranged just on the downstream side of the warp beam W in order to group the warps delivered from the warp beam W into four separate warp sheets Y1 to Y4 of different colors and to releasably hold the ends of the warps forming the warp sheets Y1 to T4. Each warp sheets Y1 to Y4 is associated with a respective warp dividing unit C1 to C4 arranged in four parallel tiers. Each warp dividing unit C includes a warp separating mechanism 200 (FIG. 7) for subsequently separating individual warps from their associated warp sheet Y, a first warp flipping mechanism 300 (FIG. 8) for flipping sideways each separated warp off its associated warp sheet, and a unit driving mechanism 400 (FIGS. 4 and 5) for moving the warp dividing unit C in the width direction of the machine along the associated warp sheet Y.

A warp leasing unit I (see FIG. 11) is arranged on the downstream side of the warp dividing units C1 to C4 in order to subsequently lease the individual warps delivered from the warp sheets Y1 to Y4 following a prescribed program. This warp leasing unit I includes a warp passing mechanism 500 (FIG. 10) which passes a warp y delivered from any warp sheet Y through the gap between a pair of leasing cords extending in the width direction of the machine. The end of the warp y so passed is then fixed with ends of previously passed warps by a warp end fixing mechanism 700 (FIG. 14). For easy and reliable fixing of the warp ends, a second warp flipping mechanism 600 (FIG. 14) is provided and flips the end of the passed warp y towards the warp end fixing mechanism 700. The leasing unit I further includes a leasing cord shifting mechanism 800 (FIGS. 13 and 14) which alternates the vertical positions of the two cords once for each passing of the warp y for the leasing purpose.

The machine further includes a leasing unit driving mechanism 900 (FIGS. 3 and 10) which enables the leasing unit I to travel in the width direction of the machine. Further, a synchronized driving mechanism 1000 is provided in order to cause a synchronized, simultaneous travel of the warp leasing unit I with any selected one of the warp dividing units C1 to C4.

The machine further includes a program control mechanism which controls operations of the warp separating and first warp flipping mechanisms 200 and 300 of each warp dividing unit C following a prescribed program.

(2) The construction and operation of the warp grouping mechanism 100.

The warp grouping mechanism 100 is, as described already, adapted group the warps y delivered from the warp beam W into warp sheets Y of different colors and to releasably hold the ends of the warps in these warp sheets Y. In the described embodiment, the warp beam W includes yarns of four different colors which are to be grouped into four separate groups Y1 to Y4.

As shown in FIGS. 1 through 3, the warp grouping mechanism 100 includes a warp nipper 105 arranged above the warp beam W, three guide bars 106, 107 and 108 arranged in spaced, parallel tiers on the downstream side of the warp nipper 105, and four releasable warp holders 101, 102, 103 and 104 arranged in spaced, parallel tiers below the guide bars 105 to 108. These members 101 to 104, 106, and 106 to 108 all extend in parallel to each other over the entire width of the machine and are held immovably by the framework (not shown) of the machine.

It should be noted that, when the warps from the warp beam W are to be grouped into N warp sheets Y1 to YN, there should be arranged (N-1) sets of guide bars and N sets of warp holders.

In the illustrated case, the warps of the first warp sheet Y1 are guided towards the warp holder 101 via the guide bar 106 so that their ends may be releasably held by the warp holder 101, the warps of the second warp sheet Y2 are guided towards the warp holder 102 via the guide bar 107 so that their ends may be releasably held by the warp holder 102, and the warps of the third warps sheet Y3 are guided towards the warp holder 103 via the guide bar 108 so that their ends may be releasably held by the warp holder 103. The warps of the fourth warp sheet Y4 are guided directly towards the warp holder 104 from the warp nipper 105 and their ends are releasably held by the warp holder 104.

(3) The construction and operation of the warp dividing units C1 to C4.

In the area between the warp nipper 105 of the warp grouping mechanism 100 and the warp releasing unit I, warp dividing units C1 to C4 are arranged in four, spaced, parallel tiers, and are each associated with one warp sheet y. When the warps y on the warp beam W are to be grouped into N warp sheets, there should be arranged N sets of warp dividing units. As later described in more detail, each warp dividing unit C may be moved in the width direction of the machine along its associated warp sheet Y. Further, each warp dividing unit C is provided with a warp separating mechanism 200, a first warp flipping mechanism 300 and a unit driving mechanism 400.

(4) The construction and operation of the unit driving mechanism 400.

In FIGS. 1 to 5, the unit driving mechanism 400 includes a transverse base rail 401 and a pinion rack 402 which is fixed on the base rail 401 and extends over the entire width of the machine. A pinion wheel 403 is mounted on the dividing unit C in meshing engagement with the pinion rack 402. This pinion wheel 403 is operationally coupled to a drive motor 404 on the unit C so that rotation of the pinion wheel 403 causes travel of the unit C along the pinion rack 402 from one to the other end of the width of the machine.

Figure 4:
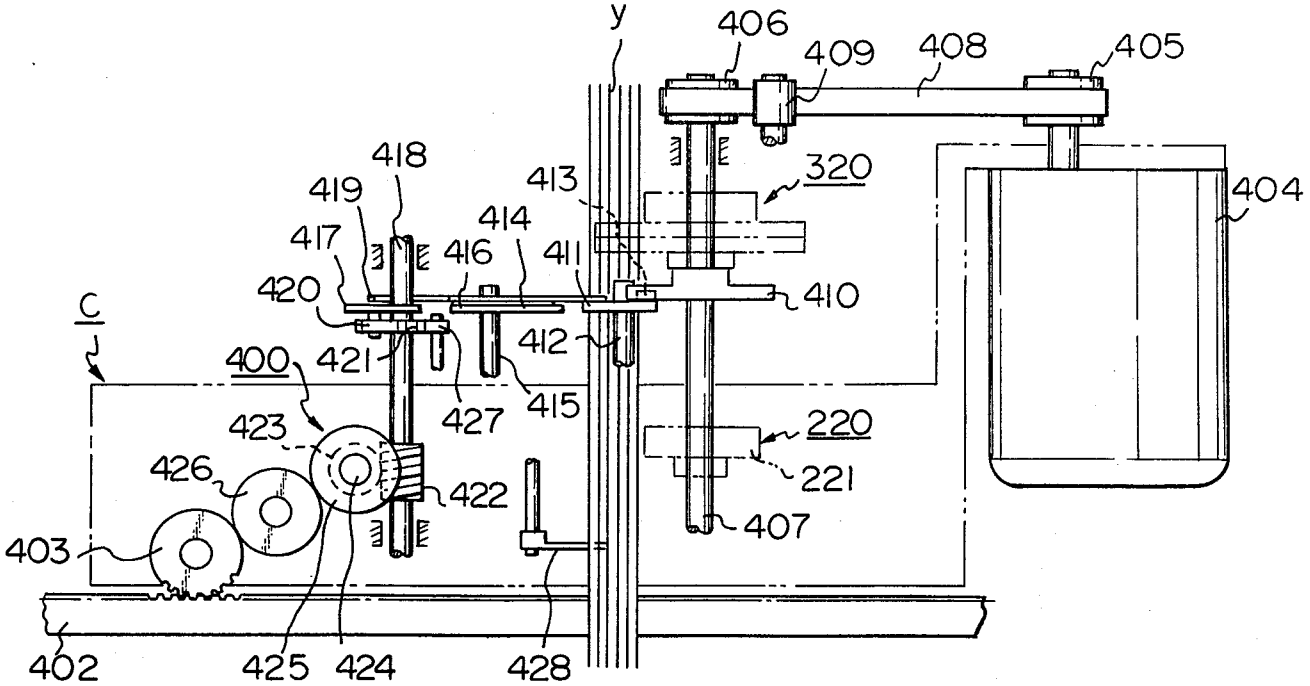
FIG. 4 is an enlarged front view of the driving mechanism for the warp dividing unit used for the machine shown in FIGS. 1 to 3.
Figure 5:
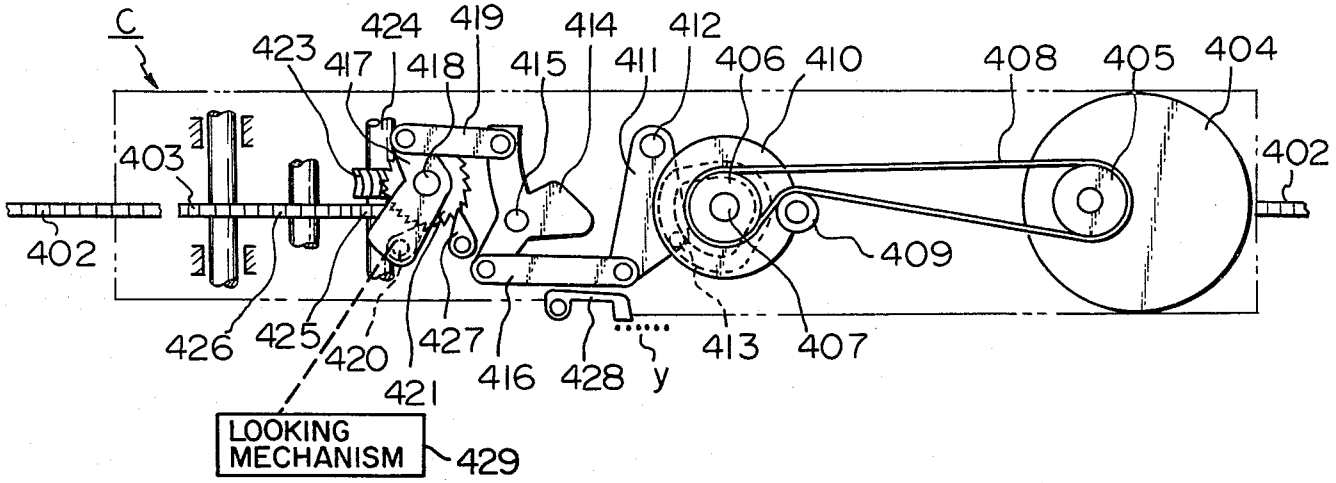
FIG. 5 is a plan view of the driving mechanism shown in FIG. 4.

More specifically in FIGS. 4 and 5, a drive pulley 405 on the output shaft of the drive motor 404 is operationally coupled to a driven pulley 406 fixed on a main shaft 407 by means of a belt 408 and a tension roller 409. A drive cam 410 is fixed on the main shaft 407. A triangular arm 411 is pivoted at its one apex to a pin 42 horizontally fixed to the framework of the unit C and rotatably holds at its another apex a cam follower 413 in engagement with the cam groove in the drive cam 410. A swingable trifurcated lever 414 is pivoted about its center to a horizontally fixed pin 415 with its lower branch being linked to the other apex of the triangular arm 411 by means of a link 416.

A bell crank type pawl holder 417 is pivoted to a horizontal, rotatable shaft 418 with its one end being linked to the upper branch of the trifurcated lever 414 by means of a link 419. The other end of the pawl holder 417 carries a pawl 420 in meshing engagement with a ratchet wheel 421 fixed on the horizontal rotatable shaft 418. This shaft 418 fixedly carries a worm 422 in meshing engagement with a worm wheel 423 fixed on a shaft 424 which in turn fixedly carries a wheel 425. This wheel 425 is operationally coupled to the above-described pinion wheel 403 by means of an intermediate wheel 426. The ratchet wheel 421 is accompanied with a locking pawl 427 in order to prevent its accidental reverse rotation. Consequently, as long as the locking pawl 427 is in operation, the ratchet wheel 421 is allowed to rotate in the counterclockwise direction only in FIG. 5.

Further, the warp dividing unit C is provided with a warp feeler 428 which detects presence of warps y in the associated warp sheet Y. The construction and operation of this warp feeler 428 are same as those of the warp feelers used for conventional tying machines. This warp feeler 428 is operationally coupled to a locking mechanism (shown) for the ratchet wheel pawl 420. When the presence of any warp y in the associated warp sheet Y is detected by the warp feeler 428, the locking mechanism provisionally locks the pawl 420 acting on the ratchet wheel 421 and the warp dividing unit C provisionally ceases running along the transverse base rail 401 in order to start the leasing operation on that particular warp y as hereinafter described in more detail.

By rotation of the drive motor 404, the pinion wheel 403 is driven for rotation and, due to engagement of the pinion wheel 403 with the rack 402 on the base rail 401, the warp dividing unit C as a whole travels transversely along the associated warp sheet Y. As the presence of any warp y is detected by the warp feeler 428, the warp dividing unit C provisionally ceases its travel for separation of that warp y from the associated warp sheet Y.

(5) The construction and operation of the warp separating mechanism 200.

This mechanism 200 is driven for operation by the drive motor 404 of the unit driving mechanism 400. In FIGS. 6 and 7, a selector cam 201 is secured to the main shaft 407 used for the drive cam 410 of the unit driving mechanism 400 (see FIGS. 4 and 5). A swingable lever 202 is secured at its one end to a horizontal shaft 203 extending in parallel to the above-described shaft 407, and carries at its other end a cam follow 204 in resilient pressure contact with the periphery of the selector cam 201. An arm 205 having a bifurcated end 206 is mounted to the other end of the shaft 203 and the bifurcated end 206 swingably holds the upper end of a warp separating vertical needle 207. As the main shaft 407 rotates, the lever 205 swings about the axis of the shaft 203 so that the vertical needle 207 reciprocates almost normally to the plane of the warp y in the associated warp sheet Y, thereby separating individual warps y from their associated warp sheet Y.

As later described in more detail, a single revolution clutch is mounted to the shaft 407 of the unit driving mechanism 400 in order to control the swinging motion of a warp separating horizontal needle 208. This horizontal needle 208 is provided at its free end with a hook 208*a* to act on the warps y in the warp sheet Y. A cam 209 coupled in one body to the above-described clutch assembly is provided with a pair of cam grooves 209*a* and 209*b* formed in the side surfaces thereof. On one side of the cam 209, a lever 210 is pivoted at its one end to a horizontal pin 211 and carries about the middle of its length a cam follower 212 in engagement with the one cam groove 209*b*. The other end of the lever 210 is coupled to the upper end of the horizontal needle 208 by means of a pin 213. On the other side of the cam 209, a bell crank 214 is pivoted at its apex to a horizontal pin 215 and carries at its one end a cam follower 216 in engagement with the other cam groove 209*a* in the cam 209. The other end of the bell crank 214 is slidably coupled to a slot 208*b* formed in the body of the horizontal needle 208 by means of a pin 217.

As the cam 209 rotates, the combined swinging motions of the lever 210 and the bell crank 214 cause a corresponding movement of the hook 208*a* of the horizontal needle 208 along an oblong locus P shown with a chain line in FIG. 7 in order to engage each warp y separated from the associated warp sheet Y by operation of the vertical needle 207, and pass the engaged warp y to the first warp flipping mechanism 300.

(6) The construction and operation of the first warp flipping mechanism 300.

Figure 8:
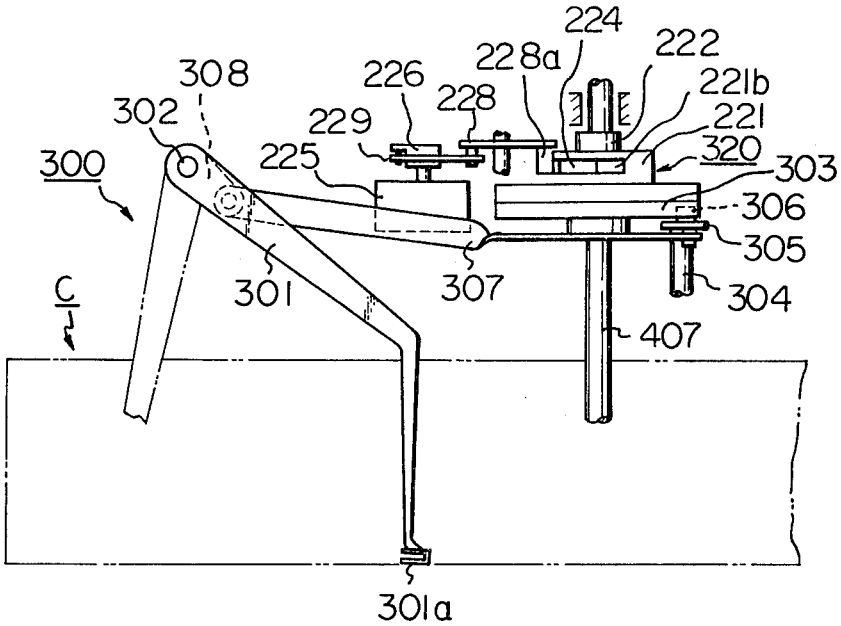
Figure 9:
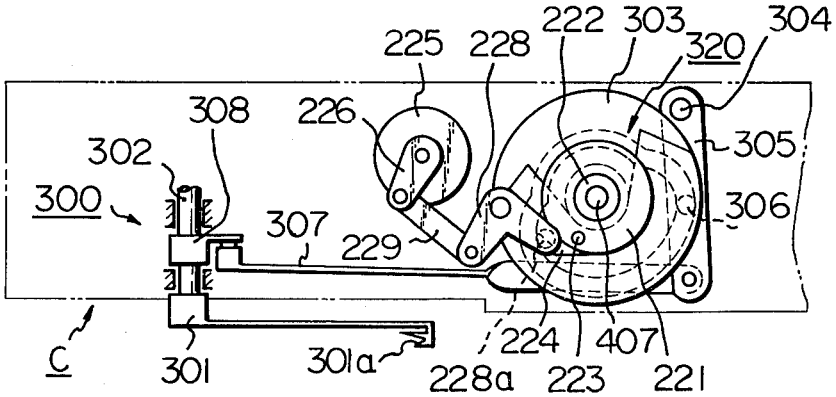

This flipping mechanism 300 FIGS. 8 and 9 is driven for operation by rotation of the main shaft 407 of the unit driving mechanism 400. A warp flipping carrier 301 is fixed at its proximal end to a vertical shaft 302 and provided at its free end with a warp catcher 301*a* receptive of the warp y engaged by the horizontal needle 208 of the warp separating mechanism 200. This flipping carrier 301 is driven for swinging motion by another single revolution clutch assembly coupled to the above-described shaft 407 of the unit driving mechanism 400.

A cam 303 is fixed on the main shaft 407 in one body with the above-described clutch assembly and a horizontal pin 304 is fixed to the framework of the dividing unit C in parallel to the shaft 407. A lever 305 is pivoted at its upper end to the pin 304 and carries, about the middle of its length, a cam follower 306 in engagement with the cam groove of the cam 303. The lower end of the lever 305 is coupled, by means of a link 307, to a lever 308 fixed on the above-described vertical shaft 302 for the flipping carrier 301.

As the shaft 407 rotates, the warp flipping carrier 301 is driven for swinging motion via the lever 305 and the link 307 in order to flip the warp y taken from the horizontal needle 208 to a position outside the associated warp sheet Y.

(7) The construction and operation of the warp passing mechanism 500.

Figure 10:
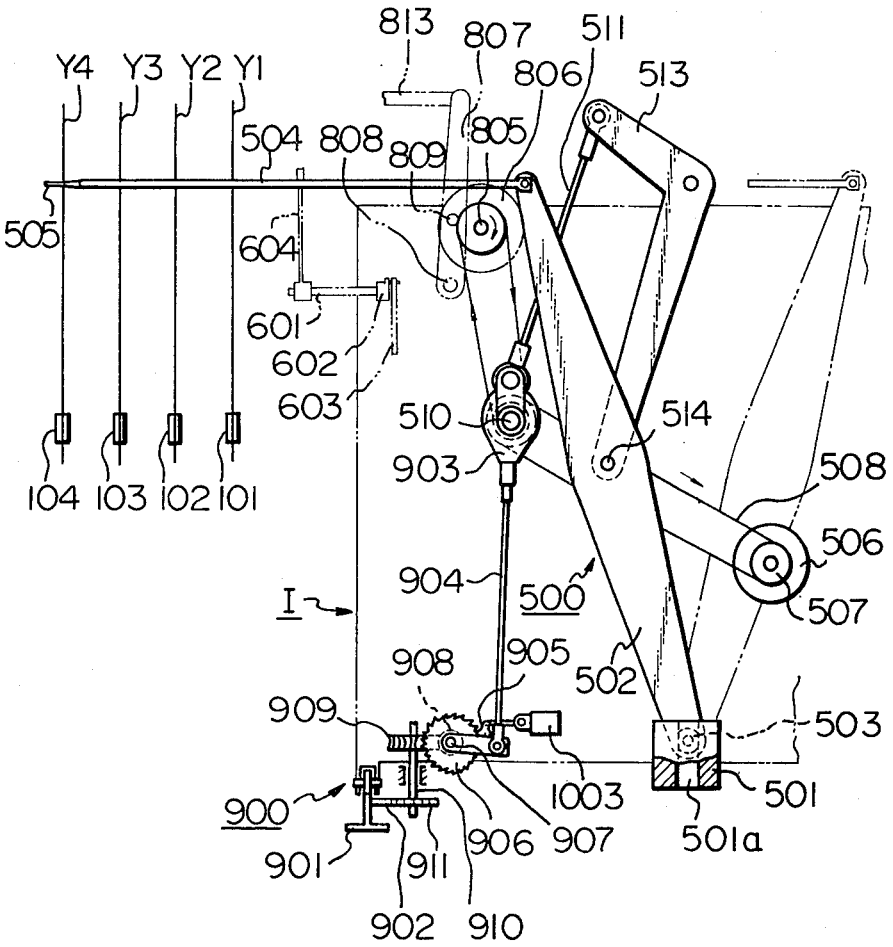
Figure 11:
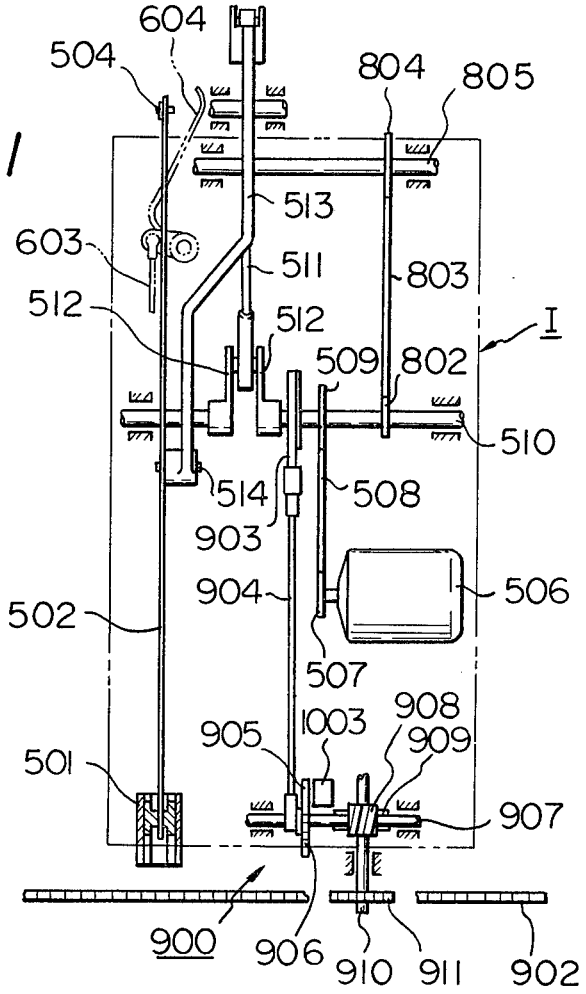
Figure 12:
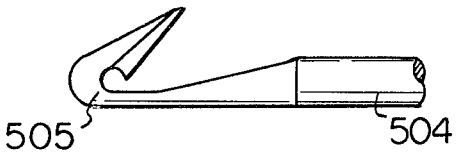
FIG. 12 is an enlarged side view of the hook used for the warp passing mechanism shown in FIGS. 10 and 11, FIGS. 13 and 14 are side and front views of the warp leasing cord shifting and second warp flipping mechanisms used for the machine shown in FIGS. 1 to 3, FIGS. 15 and 16 are partly sectional side and plan views of the single revolution clutch assemblies used for the machine shown in FIGS. 1 to 3.

In FIGS. 10 to 12, the passing mechanism 500 includes a guide rail 501 arranged on the bottom framework of the warp leasing unit I. This guide rail 501 has a slot 501*a* for a vertical stick 502. That is, the bottom end of the stick 502 is received in the slot 501*a* by means of a piece 503. The upper end of the vertical stick 502 is pivoted to one end of a horizontal rod 504 which is provided at the other end with a hook 505 (shown in FIG. 12) adapted to catch the warp y separated from the associated warp sheet Y by the warp flipping mechanism 300 of any warp dividing unit C.

A drive motor 506 is mounted to the framework of the leasing unit I and a drive sprocket 507 fixed to the output shaft of the drive motor 506 is operationally coupled, by means of an endless chain 508, to a driven sprocket 509 fixed on a rotary crank shaft 510. An upwardly extending rod 511 is pivoted at its lower end to arms 512 radially mounted on the crank shaft 510. The upper end of the rod 511 is pivoted to the upper end of a bell crank 513 whose lower end is pivoted to the body of the stick 502 by means of a pin 514.

As the drive motor 506 rotates, the vertical stick 502 is driven for reciprocal swinging motion so that the rod 504 with the hook 505 reciprocates horizontally through the region of the warp dividing units C1 to C4 and the hook 505 catches a warp y separated from any warp sheet Y by the first warp flipping mechanism 300.

(8) The construction and operation of the leasing cord shifting mechanism 800.

The shifting mechanism 800 acts on a pair of warp leasing cords 801*a* and 801*b* horizontally extended over the entire width of the machine about the level of the hook 505 of the warp passing mechanism 500 while being operationally coupled to the crank shaft 510 of the warp passing mechanism 500.

Figure 13:
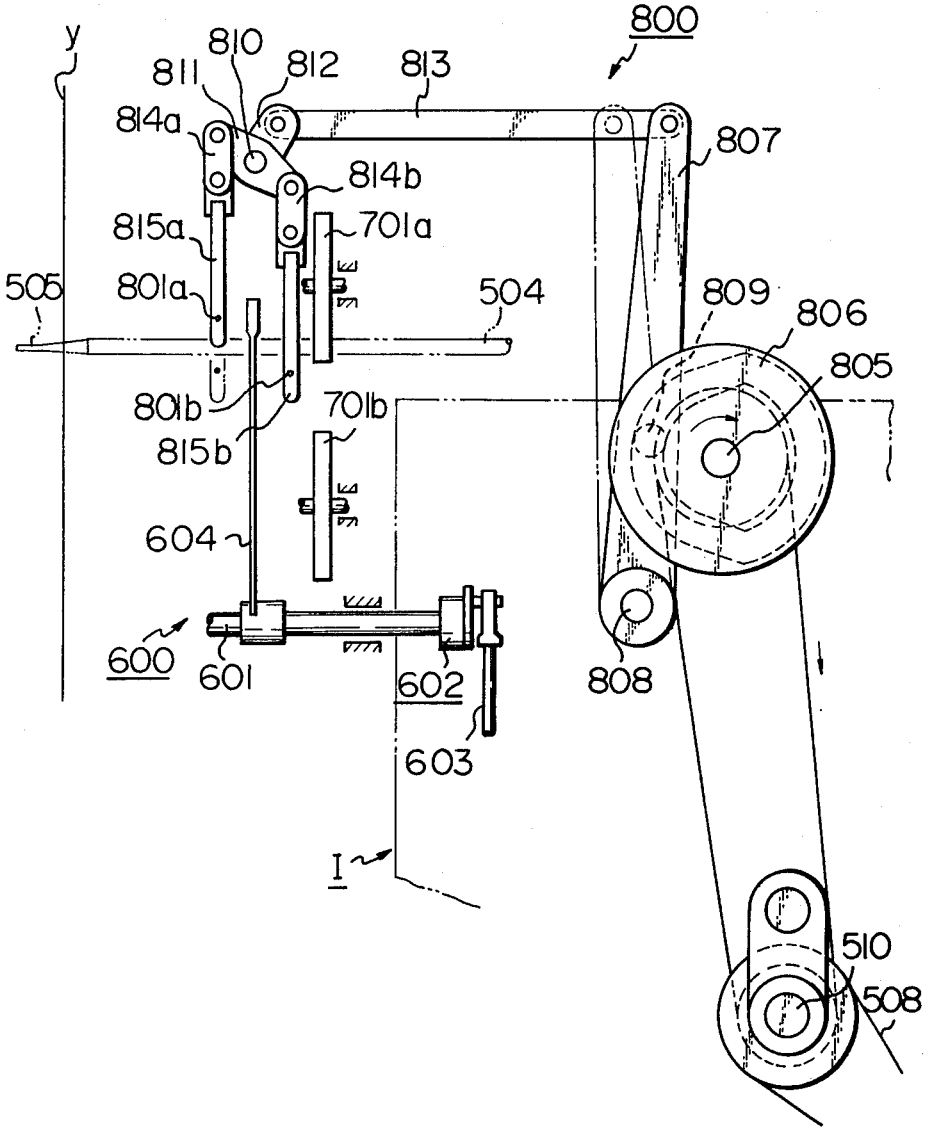
Figure 14:
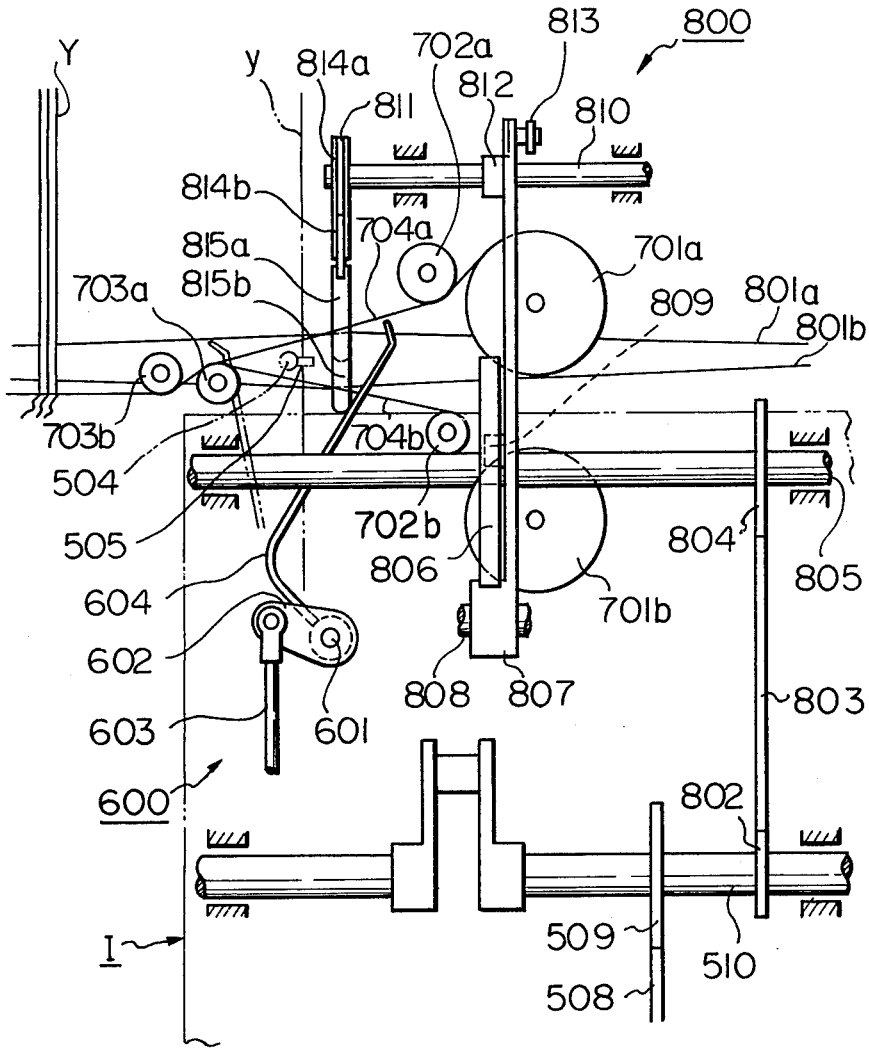

In FIGS. 13 and 14, a sprocket 802 is fixed on the crank shaft 510 and operationally coupled, by means of a chain 803, to a sprocket 804 fixed on a horizontal rotary shaft 805 which also fixedly carries a cam 806. A vertical swing lever 807 is pivoted at its lower end to a horizontal pin 808 and carries, about the middle of its length, a cam follower 809 in engagement with a cam groove formed in one side face of the cam 806. At a position above the leasing cords 801*a* and 801*b*, a horizontal shaft 810 is rotatably carried by the framework of the leasing unit I in parallel to the crank shaft 510 and a lever 811 is pivoted at its middle to the pin 810. A radial arm 812 is fixed at its lower end to the rotary shaft 810, and its top end is operationally coupled to the top end of the vertical lever 807 by means of a link 813. Short links 814*a* and 814*b* are pivoted to the respective ends of the swing lever 811 and carries lifter rods 815*a* and 815*b* for the leasing cords 801*a* and 801*b*, respectively.

As the lever 807 swings rightwards in FIG. 13, the swing lever 811 turns clockwise by rotation of the cam 806 in order to lift the leasing cord 801*a* above and lower the leasing cord 801*b* below the reciprocating course of the hook 505. Whereas, as the lever 807 swings leftwards, the swing lever 811 turns counterclockwise by further rotation of the cam 806 in order to lower the leasing cord 801*a* below and raise the leasing cord 801*b* above the reciprocating course of the hook 505. The arrangement is designed so that the cam 806 completes one rotation per two reciprocations of the hook 505 which passes one warp y from any warp sheet Y through the gap between the two leasing cords 801*a* and 801*b* per one reciprocation. The leasing cords 801*a* and 801*b* are brought to alternate positions above and below the warps y passed through the gap between them. Consequently, the warps y are subsequently interlaced with the leasing cords 801*a* and 801*b* for the leasing purpose.

(9) The construction and operation of the second warp flipping mechanism 600.

This warp flipping mechanism 600 is driven for operation by the crank shaft 510 of the warp passing mechanism 500.

In FIGS. 13 and 14, a horizontal shaft 601 is rotatably mounted to the framework of the warp leasing unit I in parallel to the reciprocating course of the hook 505. A lever 602 is fixed at its one end to the shaft 601 and pivoted at its the other end to the top end of a vertical rod 603 which is in turn operationally coupled to a cam (not shown) mounted on the crank shaft 510 so that it reciprocates vertically as the cam rotates. A bent flipping bar 604 is fixed at its lower end to the shaft 601 in an arrangement such that the top end of the bar 604 is located about the middle of the gap between leasing cords 801*a* and 801*b*.

At an instant after an warp y has been passed through the gap between the leasing cords 801*a* and 801*b* by the operation of the hook 505, the cam on the crank shaft 510 pulls down the vertical rod 603 so that the flipping bar 604 swings to the position shown with chain lines in FIG. 14 in order to flip the end of the warp y towards the warp end fixing mechanism 700.

(10) The construction and operation of the warp end fixing mechanism 700.

The fixing mechanism 700 is arranged on the front side of the leasing cords 801*a* and 801*b* as shown in FIGS. 13 and 14. That is, the mechanism 700 includes a pair of vertically spaced bonding tape rolls 701*a* and 701*b* which are mounted to the framework of the leasing unit I for free rotation. The rolls 701*a* and 701*b* are accompanied with guide rollers 702*a* and 702*b*. Laterally spaced from the rollers 702*a* and 702*b*, a pair of further guide rollers 703*a* and 703*b* are arranged in the close proximity of the gap between the leasing cords 801*a* and 801*b*.

Bonding tapes 704*a* and 704*b* are delivered from the rolls 701*a* and 701*b* and, via the guide rollers 702*a* and 702*b*, led to the gap of the guide rollers 703*a* and 703*b* while sandwiching each warp y passed through the gap between the leasing cords 801*a* and 801*b* in order to fixedly hold the end of the warp y. Delivery of the bonding tapes 704*a* and 704*b* is effected by travel of the leasing unit I in the width direction of the machine.

(11) The construction and operation of the leasing unit driving mechanism 900.

Reverting to FIGS. 10 and 11, the driving mechanism includes a horizontal base rail 901 mounted on the bottom framework of the leasing unit while extending over the entire length of the machine, and a pinion rack 902 mounted to the base rail 901. An arm 903 is fixed to crank shaft 510 of the warp passing mechanism 500 and its lower end is pivoted to the upper end of a link rod 904 so that the link rod 904 reciprocates vertically as the crank shaft 510 rotates. A pawl 905 is held by the lower end of the link rod 904 in meshing engagement with a ratchet wheel 906 fixed on a horizontal rotary shaft 907. A worm wheel 908 fixed on this rotary shaft 907 meshes with another worm wheel 909 fixed on a vertical rotary shaft 910 which fixedly carries pinion wheel 911 in meshing engagement with the pinion rack 902 on the base rail 901.

As the crank shaft 510 rotates, the pawl 905 held by the link rod 904 rotates the ratchet wheel 906 with the horizontal shaft 907, and this causes rotation of the pinion wheel 911 so that the leasing unit I as a whole travels intermittently along the base rail 901 in the width direction of the machine.

(12) The construction and operation of the synchronized driving mechanism 1000.

This driving mechanism 1000 controls the synchronized, simultaneous travel of the warp leasing unit I with any selected one of the warp dividing units C1 to C4.

In FIGS. 1 to 3, the mechanism I includes a photoelectric sensor 1001 fixed to one side framework of the leasing unit I. At positions receptive of a beam emanated by the sensor 1001 on the leasing unit I, light reflecting plates 1002 are set to one side ends of the warp dividing units C1 to C4 so that reflection of the beam by any of the plates 1002 make the sensor 1001 issue a detection signal. This sensor 1001 is electrically connected to an electromagnet 1003 arranged close to the pawl 905 of the leasing unit driving mechanism 900.

When reflection of the beam by any of the reflecting plates 1002 is sensed by the photoelectric sensor 1001, a detection signal is passed over to the electromagnet 1003 so that the latter attracts the pawl 905 in order to disengage same from the ratchet wheel 906. This causes discontinuation between the pinion wheel 911 and the crank shaft 510 and, consequently, the leasing unit I ceases its travel along the base rail 901.

When no reflection of the beam is sensed by the photoelectric sensor 1001, the electromagnet 1003 remains inoperative and the leasing unit I keeps on its travel in the width direction of the machine.

(13) The construction and operation of the single revolution clutch assemblies 220 and 320.

As described already, two clutch assemblies 220 and 320 are used in the present invention, one for the warp separating mechanism 200 and the other for the first warp flipping mechanism 300. These single revolution clutch assemblies 220 and 320 are common in construction and operation, and coupled to a common main shaft 407 of the unit driving mechanism 400 on each warp dividing unit C.

Figure 15:
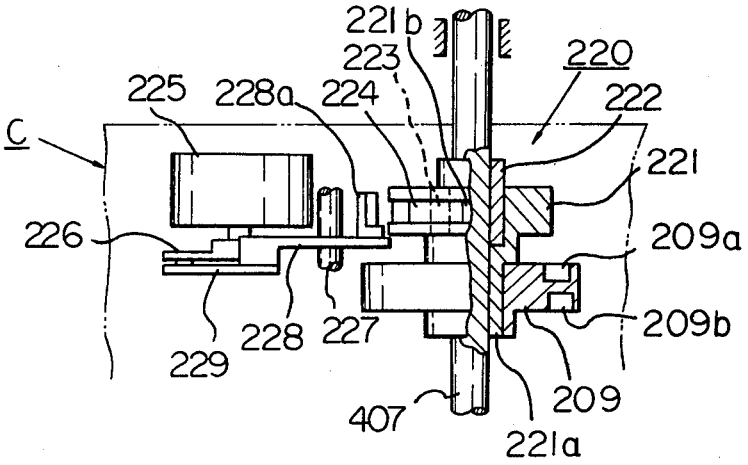
Figure 16:
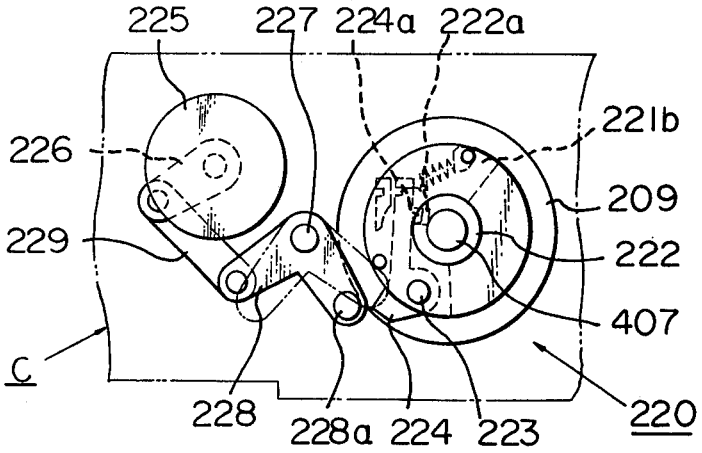

The construction of the single revolution clutch assembly 220 is shown in detail in FIGS. 15 and 16, in which the clutch assembly 220 includes a clutch main body 221 having a boss 221*a* idly inserted over the main shaft 407 of the warp dividing unit driving mechanism 400. The main body 221 has a center recess 221*b* accommodating a locking sleeve 222 fixedly inserted over the main shaft 407. A locking recess 222*a* is formed in the peripheral surface of the locking sleeve 222. A pin 223 is fixed to the main body 221 while partly exposed in the above-described center recess 221*b* in which the pin 223 pivotally carries a locking pawl 224. A projecton 224*a* is formed of one end of the locking pawl 224 in an arrangement engageable with the locking recess 222*a* in the sleeve 222 as the pawl 224 swings about the pin 223 due to spring force acting thereon. A rotary solenoid 225 is arranged in the vicinity of the clutch main body 221 and its output shaft fixedly carries a radial arm 226. At a position between the main body 221 and the solenoid 225, a pin 227 is fixed, in parallel to the main shaft 407, to the framework of the warp dividing unit C. A bell crank 228 is pivoted at its apex to the pin 227 and its one end is coupled to the radial arm 226 by means of a link 229. A pin 228*a* is formed on the other end of the bell crank 228 in an arrangement able to be placed in resilient pressure contact with the other end of the locking pawl 224 as shown with chain lines. As described already, the clutch main body 221 is formed in one body with the cam 209 of the warp separating mechanism 200.

When the warp separating mechanism 200 is to operate, the rotary solenoid 225 is energized to turn the radial arm 229 clockwise in FIG. 16 and the bell crank 228 swings leftwards in order to disengage its pin 228*a* from the end of the locking pawl 224 as shown with solid lines in FIG. 16. Thereupon the pawl 224 swings rightwards about the pin 223 in order to bring its locking projection 224*a* into engagement with the recess 222*a* in the sleeve 222 fixed on the main shaft 407 due to the spring force. In this way, the clutch main body 221 is locked to the sleeve 222. In other words, the cam 209 of the warp separating mechanism 200 is coupled to the main shaft 407 of the warp dividing unit driving mechanism 400 by means of the clutch assembly 220.

The moment the warp separating mechanism 200 has separated one warp y from its associated warp sheet Y, the solenoid 225 is again energized adversely to turn the radial arm 229 counterclockwise in FIG. 16 and the bell crank 228 swings rightwards in order to bring its pin 228*a* into pressure contact with the end of the locking pawl 224 as shown with chain lines in FIG. 16. Thereupon the pawl 224 swings leftwards about the pin 223 against the spring force in order to disengage its locking projection out of the recess 222*a* in the sleeve 222 fixed on the main shaft 407. In this way, the main body 221 is released from the catch by the sleeve 222. In other words, the cam 209 of the warp separating mechanism 200 is disengaged from the main shaft 407 of the warp dividing unit driving mechanism 400 by means of the single revolution clutch assembly 220.

In the same way, the warp flipping mechanism 300 is provisionally and periodically coupled to the main shaft 407 of the driving mechanism 400 in order to subsequently flip the warps separated from the associated warp sheet by the separating mechanism 200.

(14) The construction and operation of the program control mechanism.

The above-described rotary solenoids for the single revolution clutch assemblies 220 and 320 are energized and disenergized at prescribed timings by the operation of the program control mechanism 1100. This control mechanism includes switches connected to the above-described solenoids 220 and 320 and generate signals in accordance with a punch card or cards which are designed in accordance with the stripe design of the fancy fabric to be woven. The construction and operation of this mechanism are basically same as those of ordinary control equipments using punch cards.

(15) The overall operation sequence of the machine.

Figure 17:
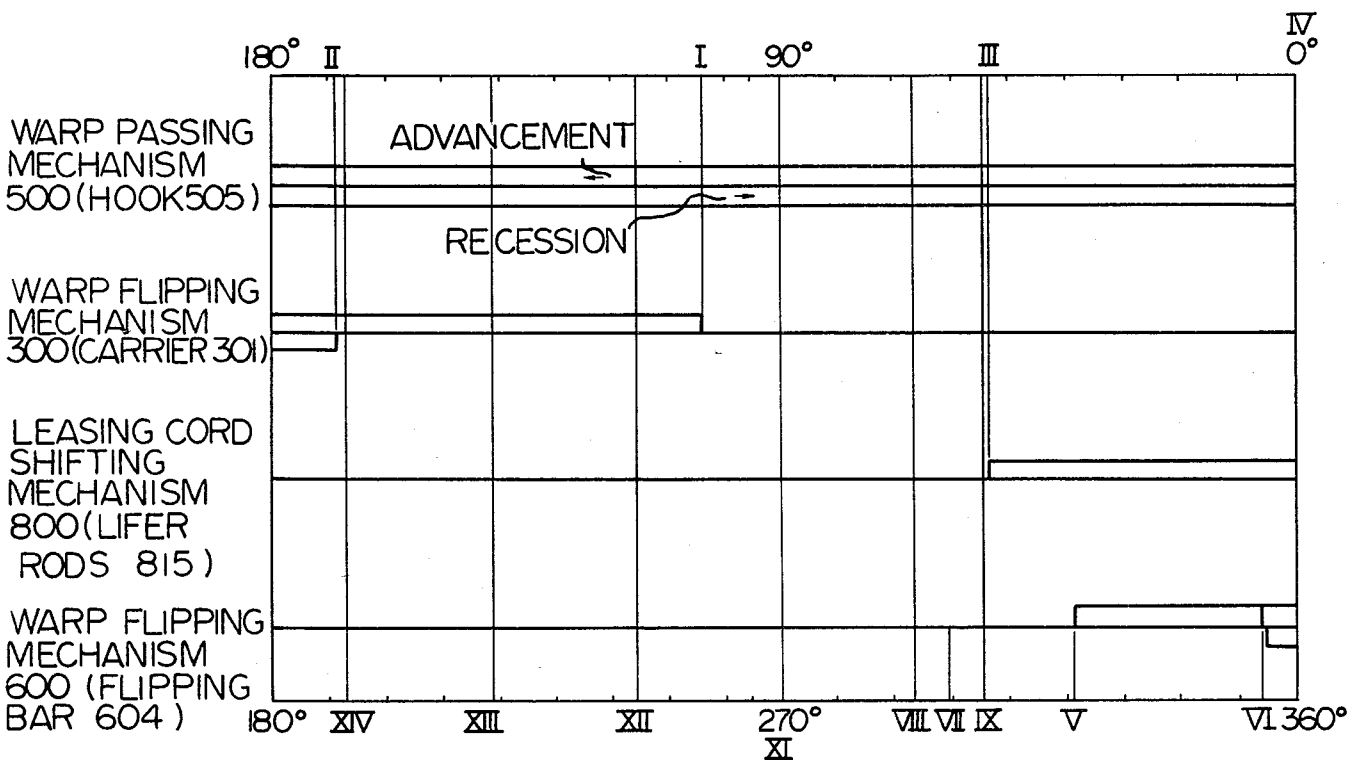
FIG. 17 is a timing chart for related operations of various mechanisms of the machine shown in FIGS. 1 to 3.

The overall operation sequence of the machine will hereinafter be described in more detail in reference to the timing chart shown in FIG. 17, in which the rotation angle of the crank shaft 510 of the warp passing mechanism 500 is taken on the abscissa. One complete rotation of the crank shaft 510 corresponds to one complete horizontal reciprocation of the hook 505 in order to pass a warp y of any selected warp sheet Y through the gap between the leasing cords 801*a* and 801*b*. During the first half rotation, i.e. rotation over 180°, of the crank shaft 510, the hook 505 advances towards the warp dividing units C1 to C4 and, during the next half rotation, it recedes towards the warp leasing unit I. Consequently, the abscissa designates positions along the entire reciprocating course of the hook 505, which in a practical example extends over 1,400 mm.

When the hook 505 of the warp passing mechanism 500 is located at a position I corresponding to 96° crank angle during its advancement, the warp flipping carrier 301 of the warp flipping mechanism 300 on the warp dividing unit C of the selected warp sheet Y starts its swinging motion which is ended when the hook 505 arrives at a position II corresponding to 192°51′ during its recession. The warp y caught by the hook 301*a* of the carrier 301 is then taken over by the hook 505 which is now receding towards the warp leasing unit I.

Shifting of the leasing cords 801*a* and 801*b* should take place after the warp y caught by the hook 505 has passed through the gap between them. That is, the lifter rods 815*a* and 815*b* of the shifting mechanism 800 are driven by shifting motion when the hook 505 is located at a position III corresponding to 307°17′, which is ended when the hook 505 arrives at a position IV corresponding to 360° crank angle.

After shifting of the leasing cords 801*a* and 801*b* has started, the warp y should be flipped towards the warp end fixing mechanism 700. Consequently, swinging motion of the flipping bar 604 of the warp flipping mechanism 600 on the leasing unit I starts when the hook 505 is located at a position V corresponding to 321°26′ crank angle, and ends when the hook 505 arrives at a position VI corresponding to 354°51′ crank angle. Return movement of the bar 604 ends when the hook 505 arrives at a position corresponding to 5°9′ in the next advancing cycle.

In the chart, the position VII corresponding to 60°25′ crank angle is the position of the pivotal axis for the flipping bar 604, i.e. the axis of the shaft 601 shown in FIG. 14.

The leasing cords 801*a* and 801*b* are located at positions VIII and IX on both sides of the above-described position VII for the flipping bar 604. Further, the warp sheets Y1 to Y4 are located at positions XI to XIV.

Signals from the program control mechanism are passed to the rotary solenoid 225, which controls the single revolution clutch assembly 320, in order to cause the swinging motion of the warp flipping carrier 301.

The reciprocal motion of the warp separating vertical needle 207 on the warp dividing unit C normal to the selected warp sheet Y separates one warp y from the sheet and the hook 208*a* of the horizontal needle 208 takes over the warp y. Signals from the program control mechanism are passed to the rotary solenoid 225, which controls the single revolution clutch assembly 220, in order to cause the motions of the two needles 207 and 208.

In accordance with the present invention, leasing of warps taken from a warp beam containing warps of different colors is carried out in a fully automatic fashion in accordance with a prescribed program recorded on punch cards, thereby greatly streamlining the weaving preparation process.

I claim:

1. A fully automatic leasing machine for a warp beam containing warps of different colors, comprising:

a warp grouping mechanism located at a position downstream of said warp beam in the processing direction of said warps, and adapted for grouping said warps into warp sheets of different colors and releasably holding ends of said warps in said warp sheets, said warp sheets being disposed in substantially parallel planes which are spaced apart and extend in the width direction of said machine;

a number of warp dividing units equal in number to the number of warp sheets, each dividing unit being associated with a respective warp sheet and being movable along its associated warp sheet in said width direction of said machine;

a respective warp dividing unit driving mechanism for each said warp dividing unit, each said warp dividing unit driving mechanism including a main shaft driven for continuous rotation, means for converting said rotation of said main shaft into movement of its respective said warp dividing unit along its said associated warp sheet, and means for selectively disabling said converting means;

a respective warp separating mechanism arranged on each said warp dividing unit, and including first and second cooperating needles for separating individual warps from said associated warp sheet, first operating means for operating said needles, and a first single revolution clutch assembly which when energized operationally couples said operating means to said main shaft of said warp dividing unit driving mechanism;

a respective warp flipping mechanism accompanying each said warp separating mechanism, and including a warp flipping carrier for flipping said each warp separated from said associated warp sheet, second operating means for operating said warp flipping carrier, and a second single revolution clutch assembly which when energized operationally couples said second operating means to said main shaft of said warp dividing unit driving mechanism;

a program control mechanism for energizing said first and second single revolution clutch assemblies on each said warp dividing unit in accordance with a desired stripe design;

a warp leasing unit arranged on the downstream side of said warp dividing units in an arrangement movable in the width direction of said machine;

a warp passing mechanism arranged on said warp leasing unit, and including a crank shaft driven for constant rotation and a hook which is operationally coupled to said crank shaft and reciprocates horizontally between said warp leasing unit and said warp dividing units in order to pass said each warp which is engaged by a said first warp flipping mechanism through a gap between a pair of warp leasing cords stretched in the width direction of said machine;

a leasing cord shifting mechanism arranged on said warp leasing unit, and including a pair of lifter rods which are operationally coupled to said crank shaft of said warp passing mechanism and to said warp leasing cords in order to alternately locate said warp leasing cords at different respective levels every time one of said warps has been passed through said gap;

a second warp flipping mechanism arranged on said warp leasing unit, and including a flipping bar operationally coupled to said crank shaft of said warp passing mechanism;

a warp end fixing mechanism arranged on said warp leasing unit including a pair of rolls of bonding tape which, as said leasing unit travels in the width direction of said machine, are delivered from said rolls and fixedly hold therebetween each said warp passed through said gap, said flipping bar flipping each said warp passed through said gap towards said warp end fixing mechanism;

a warp leasing unit driving mechanism accompanying said warp leasing unit, and including means for converting rotation of said crank shaft of said warp passing mechanism into movement of said warp leasing unit in said width direction of said machine; and a synchronized driving mechanism including a photoelectric sensor for detecting movement of any said warp dividing unit in said width direction of said machine, and means connected to said photoelectric sensor for disabling said converting means of said warp leasing unit dividing mechanism when no warp dividing unit moves in said width direction of said machine.

2. A fully automatic leasing machine as claimed in claim 1 in which said warp grouping mechanism includes a warp nipper arranged over said warp beam and extending across said processing course of said warps, and a plurality of warp holders equal in number to the number of colors of said warps, said warp holders being arranged below said warp nipper for releasably holding ends of said warps.

3. A fully automatic leasing machine as claimed in claim 1 in which said converting means of said warp dividing unit driving mechanism includes a pinion rack extending in said width direction of said machine, a pinion wheel mounted to said warp dividing unit in meshing engagement with said pinion rack, a ratchet gearing operationally coupled to said pinion wheel, a drive cam fixed on said main shaft and means for operationally coupling said drive cam to said ratchet gearing.

4. A fully automatic leasing machine as claimed in claim 3 in which said disabling means of said warp dividing unit driving mechanism includes a warp feeler mounted to said warp dividing unit and means coupled to said warp feeler for making said ratchet gearing of said converting means ineffectual when presence of any warp in said associated warp sheet is sensed by said warp feeler.

5. A fully automatic leasing machine as claimed in claim 1 in which said cooperating needles of said warp separating mechanism include a first needle reciprocal substantially along a straight line through a gap between adjacent warps in said associated warp sheet, and a second needle movable along an oblong locus while hooking each said warp separated from said associated warp sheet by said first needle.

6. A fully automatic leasing machine as claimed in claim 1 in which said first operating means of said warp separating mechanism includes a cam coupled to said first single revolution clutch assembly, said cam having first and second cam grooves, and first and second linkages coupling said first and second cam grooves to said first and second cooperative needles, respectively.

7. A fully automatic leasing machine as claimed in claim 6 in which said first single revolution clutch assembly includes a main body idly inserted over said main shaft and coupled in one body to said cam, a sleeve fixed to said main shaft, and means for provisionally locking said main body to said sleeve upon energization thereof by sid program control mechanism.

8. A fully automatic leasing machine as claimed in claim 7 in which said locking means include a rotary solenoid electrically connected to said program control mechanism, a spring-loaded locking pawl pivoted to said main body in an arrangement engageable with said sleeve, and a linkage coupling the output shaft of said rotary solenoid to said locking pawl.

9. A fully automatic leasing machine as claimed in claim 1 in which said second operating means of said first warp flipping mechanism includes a cam coupled in one body to said second single revolution clutch assembly, and a linkage coupling said cam to said warp flipping carrier.

10. A fully automatic leasing machine as claimed in claim 9 in which said second single revolution clutch assembly includes a main body idly inserted over said main shaft and coupled in one body to said cam, a sleeve fixed to said main shaft, and means for provisionally locking said main body to said sleeve upon energization thereof by said program control mechanism.

11. A fully automatic leasing machine as claimed in claim 1 in which said converting means of said warp leasing unit driving mechanism includes a pinion rack extending in said width direction of said machine, a pinion wheel mounted to said warp leasing unit in meshing engagement with said pinion rack, a ratchet gearing operationally coupled to said pinion wheel, and a linkage coupling said crank shaft of said warp passing mechanism to said ratchet gearing.

12. A fully automatic leasing machine as claimed in claim 11 in which said disabling means of said synchronized driving mechanism includes an electromagnet electrically connected to said photoelectric sensor and actable on a pawl of said ratchet gearing of said converting means.

* * * * *